US005971166A

United States Patent [19]

Ong

[11] Patent Number: 5,971,166

[45] Date of Patent: Oct. 26, 1999

[54] HANGING BOX FILE WITH COMPARTMENTS

[76] Inventor: Bon S. Ong, Box 4247, Torrance, Calif. 90510

[21] Appl. No.: 09/250,000

[22] Filed: Feb. 16, 1999

[51] Int. Cl.[6] ..... A47F 5/00

[52] U.S. Cl. ..... 211/46; 211/184; 312/184

[58] Field of Search ..... 211/46, 189, 113, 211/184; 312/184, 183

[56] References Cited

U.S. PATENT DOCUMENTS

| | | | |
|---|---|---|---|
| 2,800,907 | 7/1957 | Jonas . | |
| 2,852,028 | 9/1958 | Patterson et al. . | |
| 3,456,994 | 7/1969 | Sullivan | 312/184 |
| 5,088,801 | 2/1992 | Rorke et al. | 312/184 |
| 5,322,167 | 6/1994 | Birutis et al. | 211/184 X |
| 5,813,734 | 9/1998 | Ong | 312/184 |
| 5,842,570 | 12/1998 | Turnbull | 312/184 X |

*Primary Examiner*—Robert W. Gibson, Jr.
*Attorney, Agent, or Firm*—Charles H. Thomas

[57] ABSTRACT

An improved box file structure is provide for use in a hanging office drawer file. A pocket member is formed of flat, sheet stock that is folded and fastened in such a way as to form a pair of transverse, mutually parallel retaining panels, a connecting web between the lower extremities of the retaining panels, and end flaps extending between the side edges of the retaining panels. A pair of rigid support bars extend through sleeves formed at the upper extremities of the retaining panels. The support bars have hooks at their ends that engage the rails of the hanging file. The connecting web and the end panels are each divided in half by a fold. The central fold in the connecting web is parallel to the support bars, while the folds that divide the end panels in half are perpendicular thereto. The structure of the pocket sheet may thereby be collapsed fully to bring the retaining panels into face-to-face contact with each other. When employed for use, on the other hand, the box file employs a floor panel that fits down into the pocket formed between the retaining panels and pushes them away from each other until the connecting web resides in a horizontal disposition. Also, both the floor panel and the sleeves that accommodate the support bars are provided with slots. Upright dividers are formed with tabs that engage these slots in both the sleeves and in the floor panel. The dividers can thereby be removably attached to both the floor panel and the sleeves with the floor panel seated in the box file pocket.

19 Claims, 6 Drawing Sheets

HANGING BOX FILE WITH COMPARTMENTS

BACKGROUND OF THE INVENTION

1. Field of the Invention

The present invention relates to an office filing device which is an improved form of a hanging file of the type used with a pair of rigid, laterally spaced, parallel rails held elevated at the top of a file storage cabinet compartment.

2. Description of the Prior Art

Hanging file system have been used in offices throughout the world for many years. In a typical hanging file arrangement, a file cabinet drawer is equipped with a pair of rails that are held elevated at the top of a file storage cabinet compartment. Hanging files, having rigid, transverse support members with hooks at their ends are supported with their file pockets depending beneath and between the rails with the bottoms of the file pockets held slightly above the floor of the file cabinet drawer. The rails may be supported directly from the file drawer walls by means of notches therein. Alternatively, a metal framework may be assembled and seated within the file cabinet drawer with the supporting rails held aloft in a mutually parallel, horizontal disposition. The rails may be oriented either parallel to or perpendicular to the direction in which the drawer pulls out of its cabinet, depending upon the support structure adopted. One exemplary hanging file support system in illustrated in U.S. Pat. No. 5,405,020.

One type of hanging file which has significant advantages in certain situations is a type of file known in the office supply industry as a box file or box bottom file. Such a file includes the conventional supporting bars with hooked ends that rest atop the supporting rail. A file pocket, typically fabricated from either stiff paper, cardboard, or some plastic sheet material hangs from the support bars. Unlike many hanging file folders, the retaining panels of which converge to a single bottom fold thus forming a "V-shaped" configuration, box files have a more rectangular configuration. Specifically, the retaining panels of a box file are oriented in a mutually parallel, generally vertical disposition and are separated from each other at their lower extremities by a generally horizontally disposed floor. A box file is normally equipped with end panels that connect to and maintain a separation between the transverse retaining panels that hang beneath the hooked support bars. One prior art-type of box file is illustrated and described in U.S. Pat. No. 5,813,734.

Box files have several advantages over hanging files having a "v-shaped" bottom. Box files, even when empty, tend to retain their shape since the box file floor and end panels hold the retaining panels apart and in a generally vertical orientation. Thus, when materials such as papers, pamphlets, reports, and the like are removed from a box file, the box file floor and end panels prevent the transverse retaining panels from collapsing toward each other. This facilitates the return to the file of papers and materials that have been withdrawn, since the top of the hanging box file remains open and ready to receive these materials. Also, even an empty box file will tend to reserve the space necessary in the file drawer to receive the papers and articles that will ultimately be returned to it. The retaining panels of V-bottom files, on the other hand, immediately collapse toward each other when the file contents are withdrawn.

One problem with conventional office box files is that the size of the pocket defined therein is relatively inflexible. That is, conventional box files are typically designed to receive only one type of article, such as papers or pamphlets having a size typically ranging between eight and a half inches by eleven inches and nine inches by twelve inches. Conventional box files do not readily accommodate articles within an office that are much smaller, for example tall and narrow pamphlets or the conventional 3.5 inch "floppy" computer discs that are now so widely utilized in office environments. If one attempts to store articles of this size in a conventional box file, the contents of the hanging box file quickly fall into disarray.

A further, very significant disadvantage of conventional box files is that they require an inordinate amount of space while they are being stored or shipped. The advantage of maintaining a particular volume of occupancy during use of a box file in an office is a disadvantage in warehousing quantities of such box files and shipping them prior to use. Stated more simply, conventional box files are not readily collapsible and therefore are inordinately bulky to store and ship.

SUMMARY OF THE INVENTION

The present invention involves a new and improved design for a hanging box file. A hanging box file constructed according to the invention has the advantage of largely preserving its configuration during use, which is characteristic of conventional box files, but has the additional advantage of being quite collapsible during storage and shipment. As a consequence, a far greater number of hanging box files according to the invention can be packaged within a limited volume of space for storage and shipment prior to use than has heretofore been possible. This leads to a considerable economy of use of these articles, since storage and shipment of office supplies prior to use represents a significant portion of the expense of such low-cost articles.

A further unique advantage to a hanging box file constructed according to the invention is that it may be divided into compartments of variable size to accommodate relatively small articles in an organized manner. For example, a hanging file according to the invention includes at least one divider which may be releaseably attached to both the floor of the hanging file and also to the sleeves that accommodate the hanging file support bar. As a consequence, the pocket of a hanging file according to the invention may be divided into a plurality of discrete compartments which will accommodate objects of selected sizes. Furthermore, the dividers that are employed with hanging files according to the invention also serve to form stiffening, structural members that enhance the rigidity of the hanging file.

In one broad aspect the invention may be considered to be a hanging box file for use with a pair of rigid, laterally separated rails held elevated at the top of a file storage cabinet compartment. The invention is comprised of a file pocket sheet, a floor panel, a pair of hanger bars, and at least one divider sheet. The file pocket sheet is an expansive, stiff structure that is bent to form a central web between a pair of mutually parallel upright retaining panels. The retaining panels rise from the central web and the file pocket sheet is folded and fastened above the retaining panels to define a pair of laterally extending sleeves thereatop. The file pocket sheet is cut to define a plurality of laterally spaced slots in both of the sleeves.

The floor panel is a flat, stiff structure that is positionable atop the web to extend between the retaining panels. Preferably, the floor panel includes a plurality of laterally spaced slots therein. The pair of hanger bars are flat and elongated and have hooks at their opposing ends. The hanger bars are disposed within the sleeves so that the hooks project therefrom for engagement with the rails.

Each divider sheet is a flat, stiff structure that is bent to form a divider panel having a pair of corners and a lower edge and sleeve-engaging tabs at each of the upper corners. Preferably, a floor tab also projects from the lower edge. The floor tab is engageable into a selected one of the slots in the floor panel. The sleeve-engaging tabs are engageable into selected slots in each of the sleeves, whereupon the divider panel is oriented perpendicular to the upright retaining panel.

Preferably, the file pocket sheet is formed with flaps that extend in opposite lateral directions from each of the retaining panels. The flaps extending from each of the retaining panels are folded and permanently secured to each other retaining panel to thereby form foldable end panels that are each permanently attached to both retaining panels. In one preferred embodiment, the file pocket sheet is formed of plastic and the flaps projecting from each retaining panel are permanently secured to each other retaining panel by heat seals.

Preferably, the hanging box file is collapsible. To this end, a fold is defined in the web to extend parallel to the hanger bars. The floor panel is removable from atop the web and the tabs are disengageable from the slots. In this way the file pocket sheet is collapsible to a condition in which the retaining panels reside in contact with each other.

In another aspect the invention may be described as a hanging file for use with a pair of rigid, laterally separated rails held elevated at the top of a file storage compartment. The hanging file is comprised of an expansive, stiff pocket sheet bent to form a pair or mutually parallel, upright retaining panels having upper and lower extremities, a connecting web extending between the lower extremities of the retaining panels, and upper margins at the upper extremities of the retaining panels. The upper margins are folded inwardly toward each other and are secured to the retaining panels to form a pair of sleeves. The pocket sheet is die cut to form a plurality of laterally spaced slots in each of the sleeves.

The invention is also comprised of a flat, stiff floor panel positionable atop the connecting web to extend between the lower extremities of the upright retaining panels. Preferably, the floor panel is die cut to form at least one slot therein. At least one divider sheet is provided and is bent to form a divider panel positionable perpendicular to the retaining panels and to the floor panel. The divider sheet has a lower edge and opposing upper corners. Fastening tabs are formed at each of the opposing upper corners and preferably at the lower edge. The fastening tabs at the upper corners of the divider panel are insertable into slots in each of the sleeves. The fastening tab at the lower edge of the divider panel is insertable into the at least one slot in the floor panel. The invention is also comprising of elongated, rigid supporting bars disposed in the sleeves and having hooked ends protruding therefrom to engage the rail. The fastening tabs at the upper corners of the divider are captured between the sleeves and the supporting bars when inserted into the slots in the sleeves. The dividers thereby reside in an orientation perpendicular to both the floor panel and the retaining panels to divide the pocket into two or more compartments.

In still another aspect, the invention may be described as an improvement in a hanging file for use with a pair of rigid, laterally spaced parallel rails held elevated at the top of a file storage cabinet compartment. The improvement of the invention is comprised of a thin, flat sheet member bent to form a plurality of mutually parallel bottom folds and defining a pair of upright, expansive, laterally extending retaining panels having upper and lower extremities with a connecting web extending therebetween. The sheet member also defines hanger sleeves parallel to the bottom folds and formed above the retaining panels at the upper extremities thereof. The hanger sleeves have mutually facing and mutually opposing surfaces. A plurality of tab-engaging slots are defined at laterally spaced intervals through the mutually facing surfaces of the sleeves. Elongated, thin, transversely extending support members are disposed within the sleeves and have hooks at their ends. The hooks of the support members extend beyond the sleeves and beyond the retaining panels for engagement with the rails.

The improvement of the invention includes a stiff, flat floor panel which is removably positioned to extend between the lower extremities of the retaining panels. A plurality of tab-engaging slots are preferably defined at laterally spaced locations through the floor panel. At least one flat, stiff, upright divider is also provided. The divider is folded to form a divider panel having upper and lower extremities and preferably at least one floor-engaging tab at the lower extremity of the divider panel. At least a pair of sleeve-engaging tabs are formed at the upper extremity of the divider panel. A separate one of the sleeve-engaging tabs is removably engageable in a slot in each of the sleeves. At least one of the floor tabs is removably engageable in one of the slots in the floor panel.

The divider panel and the floor panel are normally equal in width. Also, the sheet member is preferably formed with a pair of flaps, one each of which projects laterally from a separate one of the retaining panels in opposite directions from each other. The extremities of the flaps remote from the retaining panels from which they project reside in contact with and are permanently secured to the other retaining panel. The flaps thereby form end panels extending between the retaining panels. In one embodiment of the invention, the flat sheet member is formed of a fusible plastic material and the flaps and the sleeves are secured to the retaining panels by heat welds. Preferably, a plurality of dividers of the type described are provided.

The invention may be described with greater clarity and particularity by reference to the accompanying drawings.

DESCRIPTION OF THE EMBODIMENT

Figure 1:
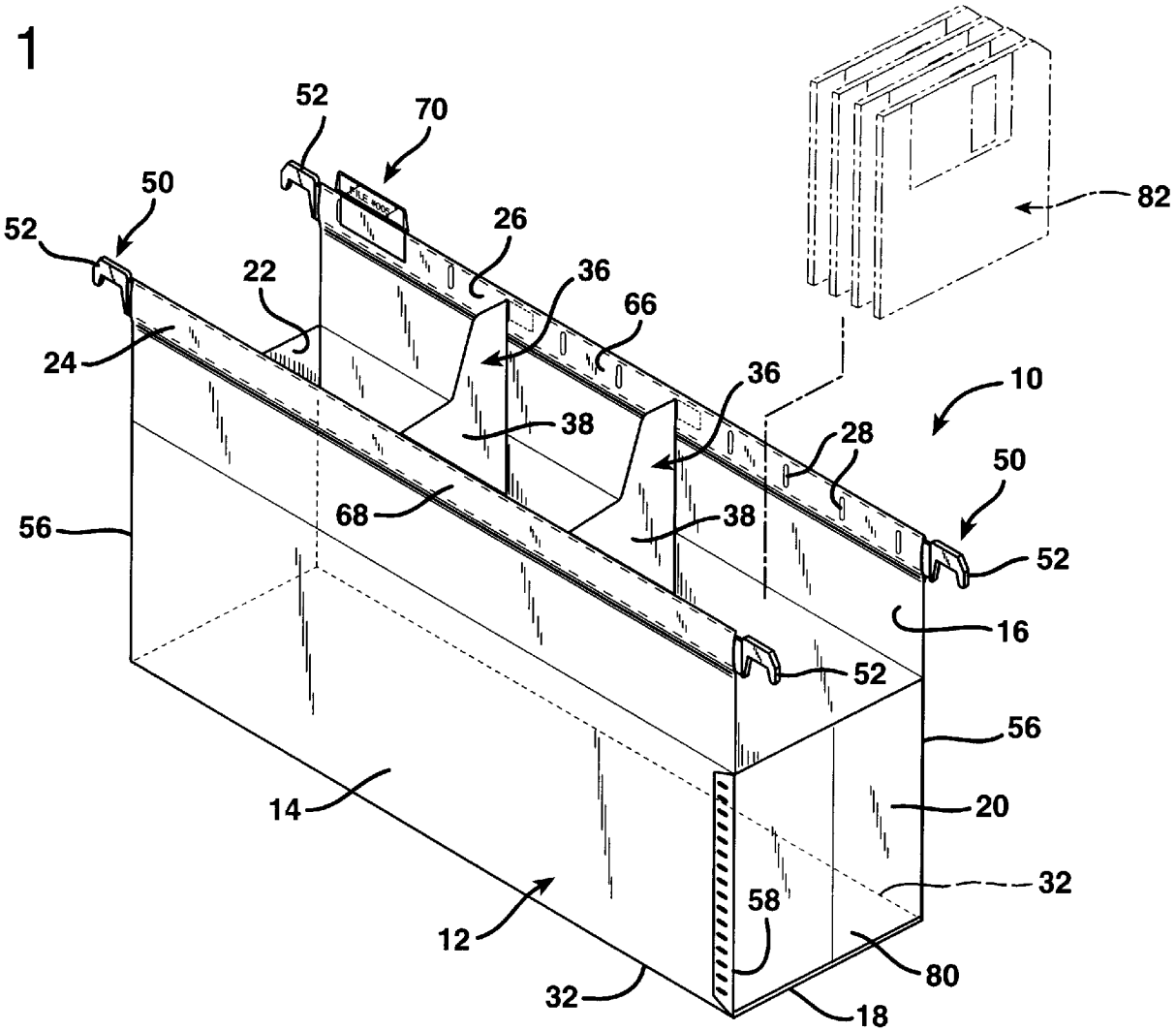
FIG. 1 is a perspective view of a preferred embodiment of a hanging file according to the invention.

FIG. 1 illustrates a hanging box file 10 which is adapted for use with a pair of rigid, laterally separated rails held elevated at the top of a file storage cabinet compartment. The hanging file 10 is comprised of an expansive, stiff pocket sheet 12 folded at folds 32 to form a pair of mutually parallel upright retaining panels 14 and 16 with a connecting web 18 extending therebetween. The pocket sheet 12 is also folded and secured to form a pair of end panels 20 and 22 and a pair of sleeves 24 and 26 above the retaining panels 14 and 16, respectively. Prior to folding the pocket sheet 12 is die cut to form a plurality of laterally spaced slots 28 in each of the sleeves 24 and 26 that the folds at the upper extremities of the retaining panels 14 and 16 create.

Figure 2:
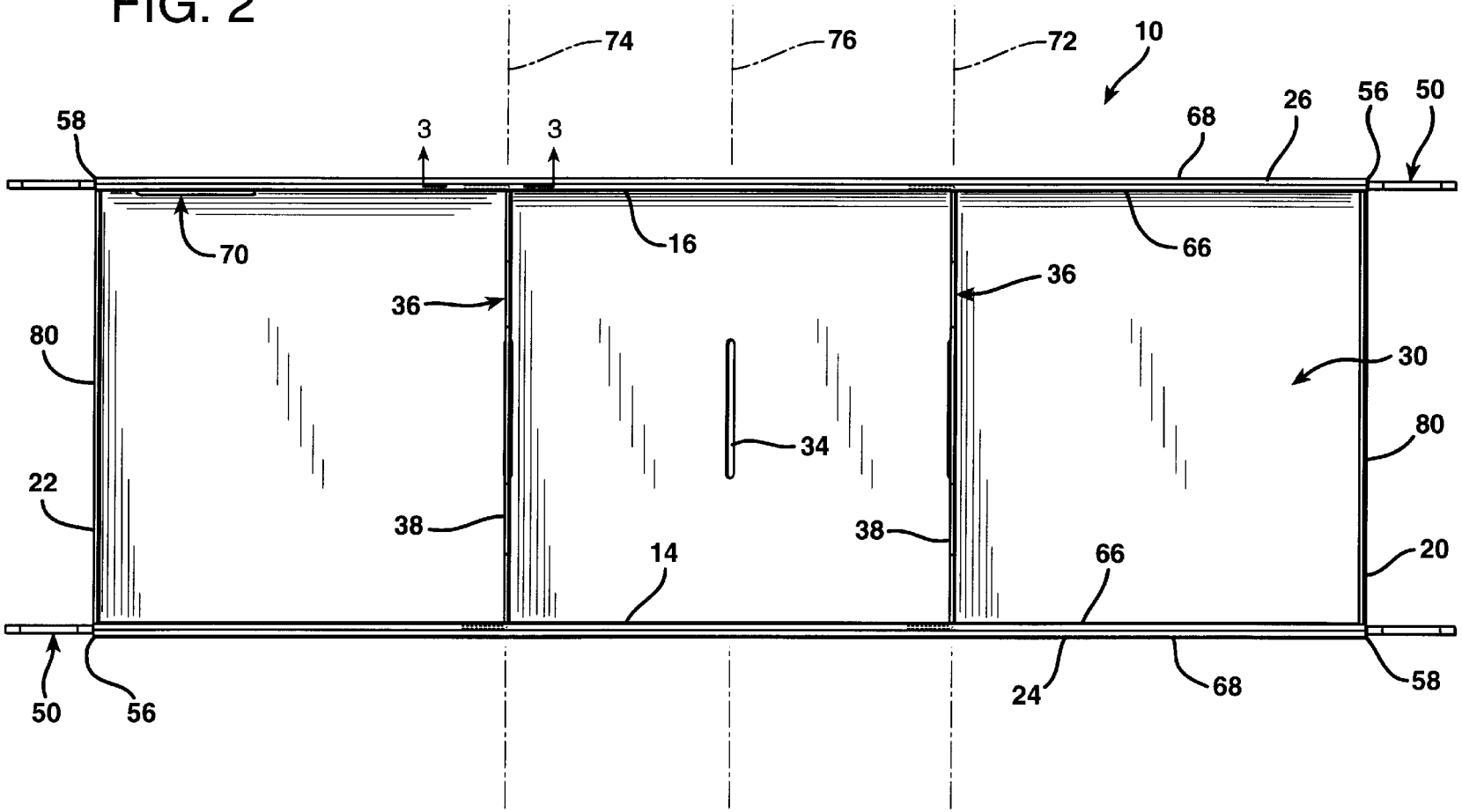
FIG. 2 is a top plan view of the hanging file of FIG. 1.

The hanging file 10 is also comprised of a flat, stiff, rectangular floor panel 30 that is positionable atop the connecting web 18. As illustrated in FIG. 2, the floor panel 30 extends between the lower extremities of the upright retaining panels 14 and 16. These lower extremities are defined by the pair of bottom folds 32 at which the retaining panels 14 and 16 are delineated from the connecting web 18. The floor panel 30 is die cut to form at least one, and preferably several, floor tab-engaging slots 34.

Figure 8:
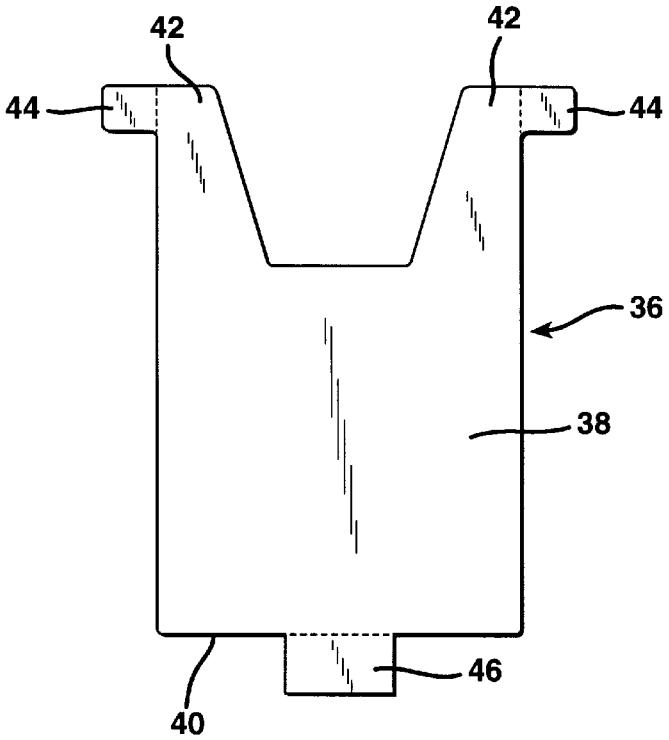
FIG. 8 is a side elevational view of one of the dividers, shown in isolation prior to folding.

The hanging file 10 also includes at least one, and preferably a plurality, of divider sheets 36, one of which is illustrated in isolation in FIG. 8. Each divider sheet 36 is bent to form a divider panel 38 which is positionable perpendicular to the retaining panels 14 and 16 and to the floor panel 30, as best depicted in FIG. 2. Each divider sheet 36 has a lower edge 40 and opposing upper corners 42, as shown in FIG. 8. A sleeve fastening tab 44 is formed at each of the opposing upper corners 42 and a floor fastening tab 46 is formed at the lower divider sheet edge 40. The fastening tabs 44 at the upper corners 42 of the divider panels 38 are insertable into selected slots 28 in each of the sleeves 24 and 26, while the fastening tab 46 at the lower edge 40 of the divider panel 38 is insertable into one of the slots 34 in the floor panel 30.

Figure 3:
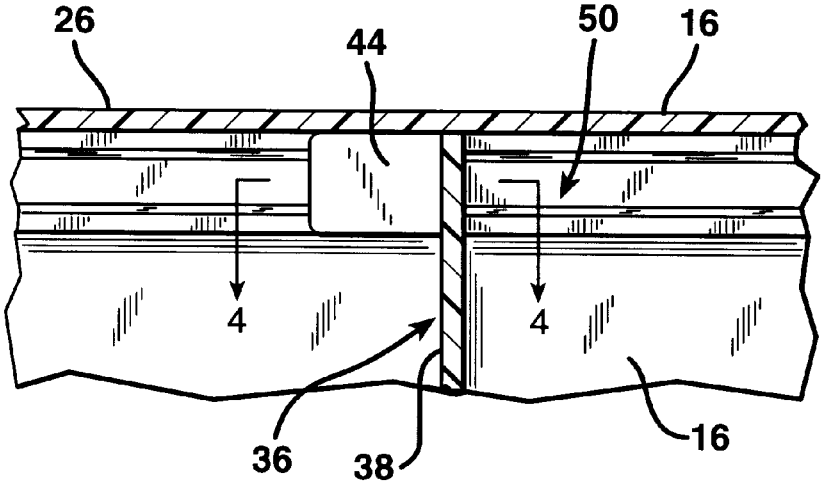
FIG. 3 is a sectional elevational detail taken along the lines 3—3 of FIG. 2.
Figure 4:
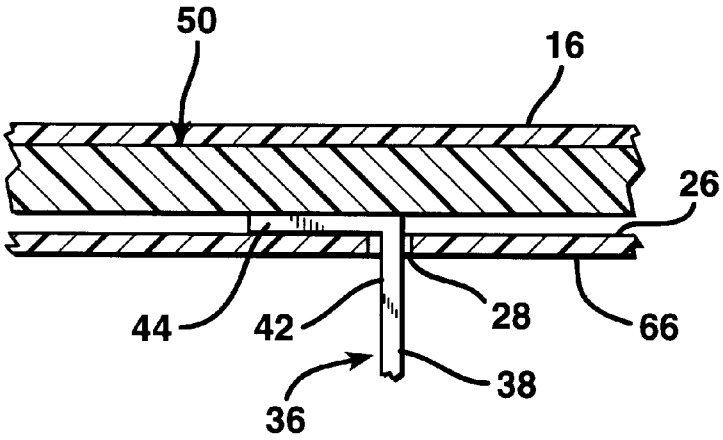
FIG. 4 is a sectional plan detail taken along the lines 4—4 of FIG. 3.

The hanging file 10 is also comprised of a pair of elongated, rigid supporting bars 50 which are disposed within the sleeves 24 and 26 and which have hooked ends 52 protruding from the sleeves 24 and 26. The bars 50 may be formed of either metal or hard plastic. The hooked ends 52 engage the conventional, mutually parallel support rails that are held elevated at the top of a file storage cabinet compartment in a conventional hanging file cabinet drawer. As best illustrated in FIGS. 3 and 4, the fastening tabs 44 at the upper corners 42 of each divider 36 are captured between the sleeves 24 and 26 and the supporting bars 50 residing therein when inserted into the slots 28 in the sleeves 24 and 26.

The pocket sheet 12 is originally formed as a flat, expansive sheet of plastic, such as polyethylene, polypropylene, or polyvinyl chloride. The lower extremities of the upright retaining panels 14 and 16 are delineated from the connecting web 18 by the transversely extending folds 32 which extend parallel to the supporting bars 50. The flaps 20 and 22 originally project laterally from each of the retaining panels 14 and 16 in opposite directions from each other. That is, the flap 20 projects laterally to the right from the retaining panel 16, as viewed in FIG. 2, while the other flap 22 extends laterally to the left from the retaining panel 14, as viewed in that same drawing figure.

Figure 6:
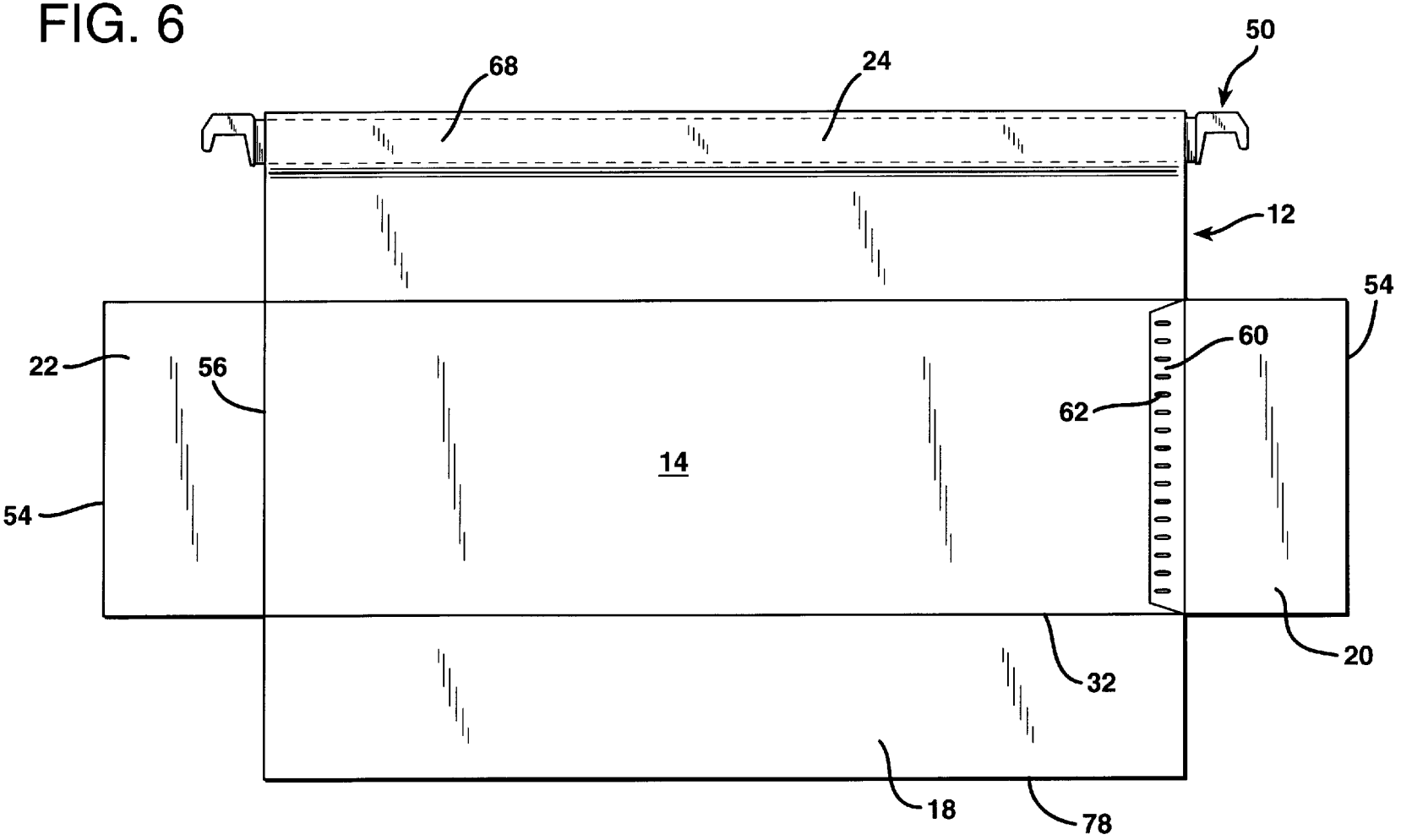
FIG. 6 illustrates the pocket sheet member of the hanging file of FIGS. 1–5 shown in a collapsed condition.
Figure 7:
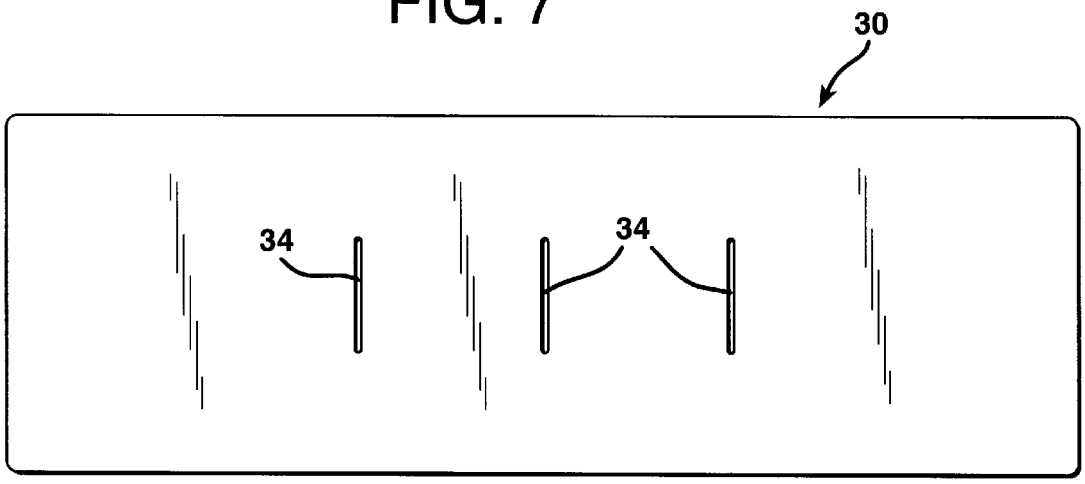
FIG. 7 is a top plan view of the floor panel of the hanging file shown in isolation.

As illustrated in FIG. 6, each of the flaps 20 and 22 on its respective retaining panel 14 or 16 is folded in half by a fold 54 and extends back into contact with the other retaining panel 14 or 16, as illustrated in FIG. 1. The end flap 20 projecting from the retaining panel 16 is folded at an end panel delineating fold 56, which forms its demarcation with the retaining panel 16, at the central, vertical, end panel center fold 54, and also at another fold 58 at the opposing vertical edge of the retaining panel 14. Likewise, the end flap 22 that originally projects from the left of the retaining panel 14, as viewed in FIG. 2, is also folded along a vertical end-panel delineation fold 56, as well as at a center end panel fold 54, and at a fold 58 proximate the distal end of the end flap 22. The distal margins 60 of the end flaps 20 and 22 that are delineated by the folds 58 are turned over into contact with the outside face of the retaining panel 14 or 16 opposite the retaining panel from which each of the flap 20 and 22 extends. The distal attachment margins 60 of the end flaps 20 and 22 are preferably secured by heat seal or heat welds 62 where they contact the opposing retaining panel. The heat seals 62 establish a permanent connection between the distal margin 60 of each of the end flaps 20 and 22 and the retaining panel which each flap contacts.

Figure 5:
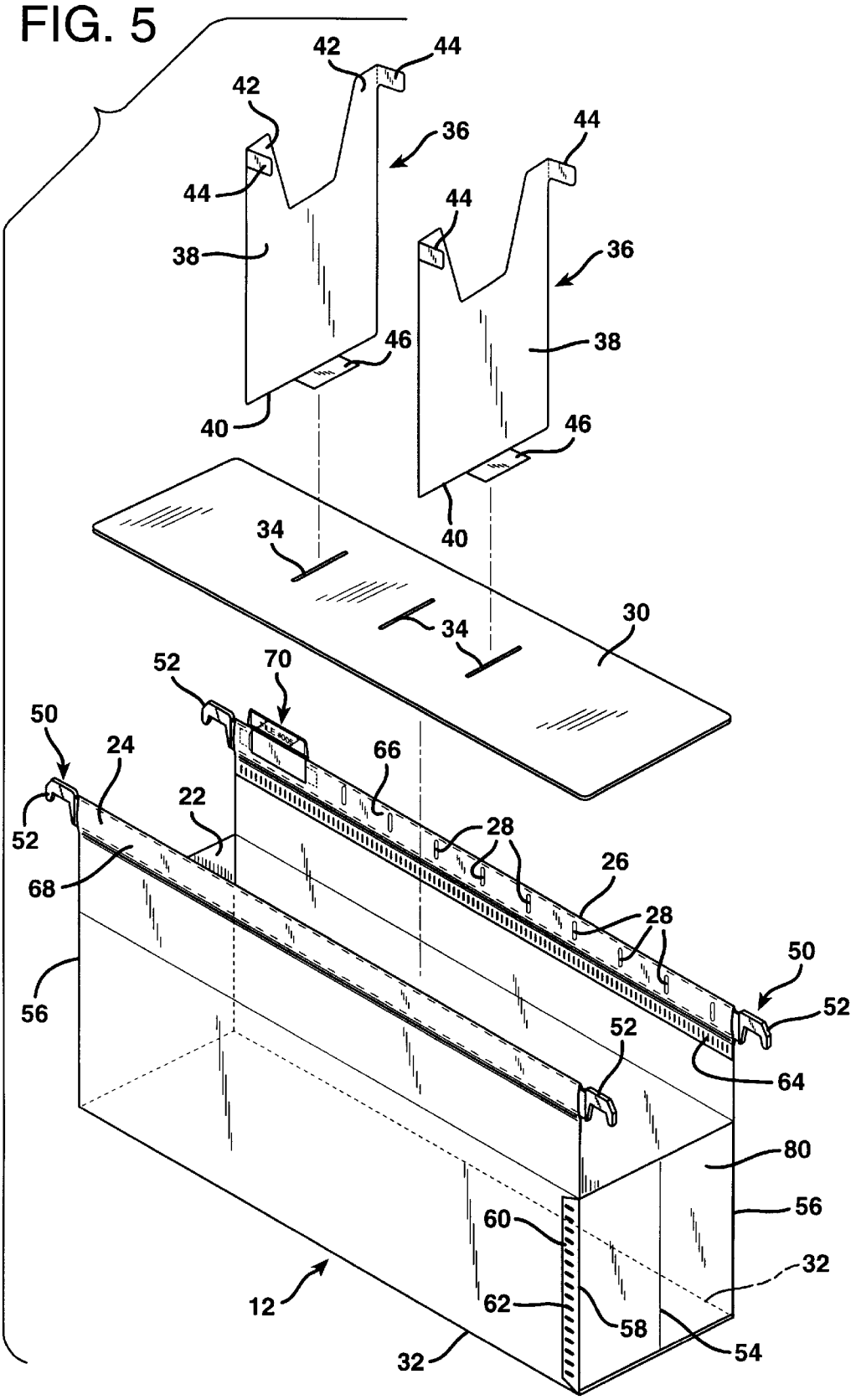
FIG. 5 is a exploded, perspective view of the hanging file shown in FIG. 1.

The pocket sheet 12 is originally provided with upper margins at the upper extremities of the retaining panels 14 and 16. These upper margins are folded inwardly toward each other and are secured to the retaining panels 14 and 16 by heat seals or welds 64 that extend the full transverse lengths of the retaining panels 14 and 16, as best depicted in FIGS. 1 and 5. These upper margins above the retaining panels 14 and 16 thereby form the sleeves 24 and 26. The sleeves 24 and 26 are parallel to the bottom folds 32 and receive the hook-ended supporting bars 50 therewithin, as best illustrated in FIGS. 2 and 6.

The hanger sleeves 24 and 26 have mutually facing surfaces 66 and mutually opposing surfaces 68. The tab-engaging slots 28 are defined at laterally spaced intervals through the mutually facing surfaces 66 of the sleeves 24 and 26. The tab-engaging slots 28 in the sleeves 24 and 26 are preferably vertically oriented slots, typically about one-half inch in length, one-eighth of an inch in width, and spaced about fifteen-sixteenths of an inch apart. The spacing and configuration of the slots 28 is such as to accommodate the attachment feet of a conventional file label holder 70, as best illustrated in FIGS. 1 and 5. The connection of file index holders 70 to the sleeves 24 and 26 utilizing the slots 28 is illustrated, for example, in U.S. Pat. No. 4,053,057.

However, in the present invention the vertical slots 28 serve not only the conventional purpose of accommodating the fastening foot tabs of a file index holder 70, but also serve to accommodate the sleeve-engaging tab 44 of dividers 36. As best illustrated in FIGS. 3, 4, and 5, a separate one of the sleeve-engaging tabs 44 is removably engageable in a slot 28 in each of the sleeves 24 and 26. Also, the floor-engaging tab 46 is removably engageably in one of the slots 34 in the floor panel 30. In the embodiment depicted there are three slots 34 in the floor panel 30.

The floor panel 30 is preferably about eleven and five-sixteenths inches in length and about three and three-quarter inches in width. The middle slot 34 is centered relative to the length of the floor panel 30, while the other two slots 31 are located a distance about two inches apart from the middle slot 34. Each of the slots 34 is preferably about one and one and one-eighth inches in length. While the floor slots 34 are fewer in number than the sleeve sots 28, the slots 34 are preferably positioned so that they are in transverse alignment with corresponding slots in the sleeves 24 and 26. This is best depicted in FIG. 2, in which it is apparent that the floor slots 34 to the right and left of the middle slot 34 reside in the same vertical planes 72 and 74 as corresponding slots 28 in the sleeves 24 and 26 into which the sleeve-engaging tabs 44 are inserted. Similarly, the centermost slots 28 in the sleeves 24 and 26 are aligned in the same vertical plane 76 as the middle floor slot 34, also as shown in FIG. 2. This alignment ensures that the dividers 36 can always be positioned so that the dividing panels 38 are in an upright, vertical orientation perpendicular to both the floor panel 30 and to the retaining panels 14 and 16.

As best illustrated in FIG. 6, the connecting web 18 has a fold 78 down its center parallel to the sleeves 24 and 26. Also, and as illustrated in FIG. 5, the floor panel 30 is removable from atop the connecting web 18. Likewise, the floor-engaging tabs 46 are movable from the floor slots 34 while the sleeve-engaging tabs 44 are removable from the slots 28 in the sleeves 24 and 26. The structure of the hanging file 10 is therefore such that the pocket sheet 12 may be collapsed flat, as illustrated in FIG. 6, so that the retaining panels 14 and 16 reside in contact with each other. The center fold 78 in the connecting web 18 and the central folds 54 in the end flaps 20 permit the pocket sheet 12 to be collapsed flat in this manner for ease of storage and shipment. The floor panel 30 is always flat and the tabs 44 and 46 may be flattened into the same plane as the divider panel 38 so that each divider 36 may be totally flattened as well.

The dividers 36 and floor panel 34 for the flattened box file 10 may either be stored conveniently between the retaining panels 14 and 16 when the pocket sheet 12 is collapsed as illustrated in FIG. 6, or packaged separately during storage and shipment. In either case a very large quantity of hanging files 10 may be collapsed into a flattened condition and stored and shipped while occupying a relatively small volume of space.

Once unpacked, on the other hand, each hanging file 10 may be readily assembled for use. In preparation for use, the collapsed pocket sheet 12 is unflattened from the condition depicted in FIG. 6 to the condition depicted in FIG. 5. The floor-engaging tab 46 of one or more of the dividers 36 is then engaged in a selected or plurality of selected floor slots 34 in the floor panel 30. The floor panel 30 is then lowered down into the pocket formed between the retaining walls 14 and 16 until the floor panel 30 reaches the lower extremities of the retaining panels 14 and 16 as delineated by the bottom folds 32. The floor panel 30 is of a width substantially equal to the width of the connecting web 18 in its unfolded condition, so that the web 18 is forced into a completely unfolded condition and into a horizontal plane, as depicted in FIGS. 1 and 5. Also, the length of the end flaps 20 and 22 is such that they likewise are extended to bring the end folds 54 that are located midway between the retaining panels 14 and 16 into coplanar alignment with the folds 56 and 58. The length of the end flaps 20 and 22 is such that the portions thereof between the fold lines 56 and 58 is equal to the width of the floor panel 30.

The end folds 54 extend in a direction perpendicular to the bottom folds 32 and 78, as viewed in FIG. 6. The central bottom fold 78 between the pair of bottom folds 32 at the lower extremities of the retaining panels 14 and 16 is formed in the connecting web 18 midway between the bottom folds 32. When the end flaps 20 and 22 are stretched outwardly by insertion of the floor panel 30 into the pocket formed by the pocket sheet 12, the portions thereof between the folds 56 and 58 reside in vertical planes perpendicular to the retaining panels 14 and 16. The flaps 20 and 22 thereby form flat, rectangular end panels 80. The end panels 80 and the divider panels 38 all have a width equal to the width of the floor panel 30.

Once the floor tabs 46 are engaged in the slots 34 and the floor panel 30 is seated at the bottom of the pocket formed between the retaining panels 14 an 16, as defined by the folds 32, the sleeve-engaging tabs 44 are inserted into those slots 28 that are vertically aligned with the floor slots 34 into which the floor tabs 46 have been inserted. The insertion of the sleeve-engaging tabs 44 into the appropriate slots 28 brings the divider panels 38 into vertical, upright alignment perpendicular to both the floor panel 30 and the retaining panels 14 and 16.

When the sleeve-engaging tabs 44 are engaged in the slots 28, they are in contact with the transversely extending support members 50, and with the sleeves 24 and 26, as best depicted in FIGS. 3 and 4. The width of the passageways formed in the sleeves 24 and 26, and the width of the support bars 50 inserted therein, is such as to press the sleeve-engaging tabs 44 between the support bars 50 and the structures of the sleeves 24 and 26, as best depicted in FIG. 4. The frictional force with which the sleeve-engaging tabs 44 are captured between the support bars 50 and the sleeves 24 and 26 is sufficient to prevent accidental dislodgement of the sleeve-engaging tabs 44. As a consequence, the dividers 36 remain fully engaged with the floor panel 30 and sleeves 24 and 26 by virtue of the removable engagement of the tabs 44 and 46 in the slots 28 and 34, respectively.

As illustrated in FIG. 1, the dividers 36, when installed as described, divide the pocket formed between the retaining panels 14 and 16 into separate compartments. The width of the floor panel 30, the end panels 80, and the divider panels 38 is preferably about three and three-quarter inches. Thus, the width of each of the three compartments formed in the hanging box file 10 is such as to snugly accommodate a row of conventional 3.5 inch floppy disks, several of which are indicated at 82 in FIG. 1, in the manner depicted in that drawing figure. The compartments thus formed are also of a size suitable for receiving relatively narrow brochures and pamphlets, which are often formed by folding standard eight and a half by eleven inch paper stock into thirds along the length of that stock.

The dividers 36 are detachable from both the sleeves 24 and 26 and the floor panel 30. The dividers 36 and floor panel 30 are all removable from the pocket sheet 12. The detachability of the dividers 36 allows them to be positioned at the appropriate locations between the end panels 80, depending upon the volume of materials to be accommodated within the compartments formed in the pocket between the retaining panels 14 and 16. If one or more of the dividers 36 is not required for a time, it may be conveniently stored atop the floor panel 30, or between the floor panel 30 and the underlying connecting web 18.

Undoubtedly, numerous variations and modifications of the invention will become readily apparent to those familiar with office file products. For example, the pocket sheet 12 may be fabricated from stiff paper or cardboard, rather than a plastic material. In such a case the margins 60 of the end flaps 20 may be secured to the retaining panel opposite that from which they project by means of an adhesive, staples, or other conventional means. Likewise, the floor panel 30 and dividers 36 can be fabricated from any number of different stiff, sheet-like materials, such as paper or cardboard. Also, while the floor panel 30 has been depicted as having three floor slots 34 and the box file 10 has been illustrated with a pair of dividers 36, any greater or lesser number of floor slots and dividers may be employed. In addition, the dividers can be bifurcated by vertical folds extending down their centers so that they do not have to be removed in order to collapse the entire hanging box file. Also, the upper margins at the upper extremities of the retaining panels 14 and 16 can be folded outwardly rather than inwardly to form the sleeves 24 and 26. Accordingly, the scope of the invention should not be construed as limited to the specific embodiment illustrated.

I claim:

1. A hanging box file for use with a pair of rigid, laterally separated rails held elevated at the top of a file storage cabinet compartment comprising:

an expansive, stiff file pocket sheet bent to form a central web between a pair of mutually parallel, upright retaining panels rising from said central web and folded and fastened above said retaining panels to define a pair of lateral extending sleeves thereatop, and wherein said file pocket sheet is cut to define a plurality of laterally spaced slots in both of said sleeves;

a flat, stiff floor panel positionable atop said web and located between said retaining panels;

a pair of flat, elongated hanger bars having hooks at their opposing ends and disposed within said sleeves so that said hooks project therefrom for engagement with said rails; and at least one flat, stiff divider sheet bent to form a divider panel having a pair of upper corers and a lower edge and sleeve-engaging tabs at each of said upper corners engageable into selected slots in each of said sleeves, whereupon said divider panel is oriented upright between said upright retaining panels.

2. A hanging box file according to claim 1 wherein said floor panel has a plurality of laterally spaced slots therein and said divider panel has a floor-engaging tab projecting from said lower edge and engageable into a selected one of said slots in said floor panel.

3. A hanging box file according to claim 1 wherein said file pocket sheet is formed with flaps extending in opposite lateral directions from each of said retaining panels, and said flaps extending from each of said retaining panels are folded and permanently secured to each other retaining panel to thereby form foldable end panels that are each permanently attached to both retaining panels.

4. A hanging box file according to claim 3 in which said file pocket sheet is formed of plastic and said flaps are permanently secured to each other retaining panel by heat seals.

5. A hanging box file according to claim 3 wherein a fold is defined in said web that extends parallel to said hanger bars, and said floor panel is removable from atop said web and said tabs are disengageable from said slots, whereby said file pocket sheet is collapsible to a condition in which said retaining panels reside in contact with each other.

6. A hanging box file according to claim 5 wherein said divider panel and said end panels all have a width equal to the width of said floor panel.

7. A hanging file for use with a pair of rigid, laterally separated rails held elevated at the top of a file storage cabinet compartment comprising:

an expansive, stiff pocket sheet bent to form a pair of mutually parallel, upright retaining panels having upper and lower extremities, a connecting web extending between said lower extremities of said retaining panels, and upper margins at said upper extremities of said retaining panels which are folded inwardly toward each other and which are secured to said retaining panels to form a pair of sleeves, and said pocket sheet is die cut to form a plurality of laterally spaced slots in each of said sleeves;

a flat, stiff floor panel positionable atop said connecting web and located between said lower extremities of said upright retaining panels;

at least one divider sheet bent to form a divider panel positionable perpendicular to said retaining panels and to said floor panel and having a lower edge and opposing upper corners, and fastening tabs at each of said opposing upper corners, whereby said fastening tabs at said upper comers of said divider panel are insertable into slots in each of said sleeves; and elongated, rigid supporting bars disposed in said sleeves and having hooked ends protruding therefrom to engage said rails, and wherein said fastening tabs at said upper corners of said dividers are captured between said sleeves and said supporting bars when inserted into said slots in said sleeves.

8. A hanging file according to claim 7 wherein said floor panel is die cut to form at least one slot therein; and a fastening tab is formed at said lower edge of said divider panel and is insertable into said at least one slot in said floor panel.

9. A hanging file according to claim 7 wherein said pocket sheet defines flaps projecting laterally from both of said retaining panels and said flaps project in opposite directions from each other and each flap on each retaining panel is folded in half and extends back into contact with each other retaining panel and is permanently secured thereto.

10. A hanging file according to claim 9 wherein said pocket sheet is formed of plastic and said flaps and said upper margins are secured to said retaining panels by heat seals.

11. A hanging file according to claim 7 wherein said connecting web has a fold down its center parallel to said sleeves and said flaps have folds down their centers perpendicular to said sleeves and said floor panel is removable from atop said connecting web and said tabs are removable from said slots to allow said pocket sheet to collapse so that said retaining panels reside in contact with each other.

12. In a hanging file for use with a pair of rigid, laterally spaced parallel rails held elevated at the top of a file storage cabinet compartment the improvement comprising:

a thin, flat sheet member bent to form a plurality of mutually parallel bottom folds and defining a pair of upright, expansive, laterally extending retaining panels having upper and lower extremities with a connecting web extending between said lower extremities and hanger sleeves parallel to said bottom folds formed above said retaining panels at said upper extremities thereof, wherein said hanger sleeves have mutually facing and mutually opposing surfaces, and wherein a plurality of tab-engaging slots are defined at laterally spaced intervals through said mutually facing surfaces of said hanger sleeves;

elongated, thin transversely extending support members disposed within said sleeves and having hooks at their ends extending beyond said sleeves and beyond said retaining panels for engagement with said rails;

a stiff, flat floor panel movably positioned and located between said lower extremities of said retaining panels;

at least one flat, stiff, upright divider that is folded to form a divider panel having upper and lower extremities and at least a pair of sleeve-engaging tabs at said upper extremities of said divider panel, whereby a separate one of said sleeve-engaging tabs is removably engageable in a slot in each of said sleeves.

13. A hanging file according to claim 12 and wherein a plurality of tab-engaging slots are defined at laterally spaced locations through said floor panel and at least one floor-engaging tab is formed at said lower extremity of said divider panel and said at least one floor tab is removably engageable in one of said slots in said floor panel.

14. A hanging file according to claim 12 wherein said divider panel and said floor panel are equal in width and said floor panel extends between said lower extremities and said retaining panels.

15. A hanging file according to claim 14 wherein said sheet member is formed with a pair of flaps, one each of which projects laterally from a separate one of said retaining panels in opposite directions from each other, and the extremities of said flaps remote from the retaining panels from which they project reside in contact with and are permanently secured to the other retaining panel, whereby said flaps form end panels extending between said retaining panels.

16. A hanging file according to claim 15 wherein said end panels have end folds midway between said retaining panels extending in a direction perpendicular to said bottom folds and wherein there are a pair of bottom folds at said lower extremities of said retaining panels and a central bottom fold in said connecting web midway between said pair of bottom panel folds, and wherein said floor panel and said divider are disengageable from said flat sheet member, whereby said retaining panels of said sheet member are collapsible toward each other by folding said sheet member at said end folds and at said central bottom fold.

17. A hanging file according to claim 16 wherein said sleeve-engaging tabs are in contact with said transversely extending support members and with said sleeves when they are engaged in said slots in said sleeves.

18. A hanging file according to claim 17 wherein said flat sheet member is formed of a fusible plastic material and said flaps and said sleeves are secured to said retaining panels by heat seals.

19. A hanging file according to claim 18 further comprising a plurality of dividers as aforesaid.

* * * * *